United States Patent [19]

Vinogradov et al.

[11] Patent Number: 4,503,901

[45] Date of Patent: Mar. 12, 1985

[54] SQUEEZING CASTER

[76] Inventors: Viktor N. Vinogradov, ulitsa Reutovskaya, 24, kv. 179; Vladimir I. Smagin, ulitsa Domodedovskaya, 31, kv. 177, both of Moscow, U.S.S.R.

[21] Appl. No.: 432,849

[22] Filed: Oct. 5, 1982

[51] Int. Cl.[3] ..... B02C 17/00

[52] U.S. Cl. ..... 164/212; 164/343; 164/436

[58] Field of Search ..... 164/207, 212, 342, 343, 164/137, 491, 436; 100/240, 264; 425/DIG. 5, 408, 411, 592, 593

[56] References Cited

FOREIGN PATENT DOCUMENTS 634848 11/1978 U.S.S.R. .

*Primary Examiner*—Mark Rosenbaum

[57] ABSTRACT

A squeezing caster comprises a bed which carries a bottom plate, an intermediate carrier member, and two dies. The intermediate carrier member is of the split type. Each of the dies is mounted on a crosspiece and provided with a mechanism which drives it along the intermediate carrier member. The crosspiece is rigidly attached to said mechanism accommodated in a housing which is mounted on the intermediate carrier member. The die driving mechanism comprises a rack and four pushers. On the external surface of each pusher there is a buttress thread meshed with an internal thread of a gear whose outer teeth are meshed with the rack. One of the racks is intended for connection to a rod of a drive cylinder and provided with a link which is kinematically coupled to the other rack. The caster also contains a means for a preliminary advance of one of the dies.

6 Claims, 5 Drawing Figures

SQUEEZING CASTER

FIELD OF THE INVENTION

The present invention relates to foundry practice. More specifically, it is concerned with a machine for casting by squeezing, further referred to as a squeezing caster.

The invention is best applicable to the production of large-size thin-walled castings, such as excavator cab panels, shells, vessels, tanks, etc.

BACKGROUND OF THE INVENTION

One of the major problems in foundry practice is to produce castings whose shape is as close as possible to that of the finished part. This is especially true of the production of large-size thin-walled castings, a process in which a maximum accuracy means a maximum efficiency, a reduced mass of castings, and a high rigidity and excellent vibration resistance of individual parts and whole structures.

However, the production of large-size thin-walled castings involves a number of difficulties of which the most serious one is the operation of filling a narrow cavity with molten metal. In an attempt to solve this problem, specialists have evolved a method known as casting by squeezing. Unlike all conventional casting techniques which make use of stationary molds, casting by squeezing is done in molds with cavities of a gradually diminishing cross-sectional size. This feature solves the basic problem of maintaining the original high temperature and fluidity of the compact mass of melt throughout the relatively short period of time during which the cavity of the mold is filled with melt.

In the case of stationary molds, the melt encounters a rapidly growing hydraulic resistance as it leaves the gating system and enters the narrow cavity of the mold. The situation is further aggravated by a decreasing temperature and increasing viscosity of the melt. The combined action of these factors may put the flow of molten metal to a stop.

Sand molds do not make it possible to produce castings with a wall thickness of 4 mm and a length of 200 to 300 mm. Metal molds do not make it possible to produce castings with a wall thickness of 3.5 mm and a length of 400 to 500 mm. Die casting does not make it possible to produce castings with a wall thickness of 1.5 to 2 mm and a length of 400 mm.

Unlike the above methods, casting by squeezing makes it possible to produce castings with a wall thickness of 2 to 2.5 mm and a length of 800 to 1,200 mm, or walls 2.5 mm thick and 800 to 1,000 mm in diameter.

In some cases casting by squeezing makes it possible to produce castings with a wall thickness of 2.5 to 3.5 mm and a length of 900 to 2,000 mm, an achievement which shows that casting by squeezing is a unique and highly promising process.

There is known a squeezing caster (cf. Sheet 28, FIG. 3 of "Liteyniye formy dlya tsvetnykh splavov"/"Casting Molds for Nonferrous Metal Alloys"/, Machinostroyeniye Publishers, Moscow, 1981) comprising a bed with a bottom plate which carries a rod for forming the internal surface of a casting, and two mold halves movable along the bed. The mold halves are driven by two power cylinders. The rod of each power cylinder is secured to the bed, while its barrel is mounted on a crosspiece. Each of the two mold halves is mounted on a respective crosspiece. The mold is preheated by heating elements arranged on the bottom plate and in the mold halves. There are two more power cylinders intended to separate a finished casting from the mold halves. Two cheeks are hingedly mounted on the sides of one mold half, each being movable in the angular direction. The cheeks are driven by a double-arm lever which has its first arm connected to the cheek and its second arm connected to the cylinder rod which, in turn, is hingedly connected to the crosspiece.

The caster in question is disadvantageous in a poor balance and frequent misalignments of the movable dies and in an excessive and nonuniform wear of the dies, bed and cheeks. The poor balance and frequent misalignments of the dies are due to the fact that the force transmitted from the hydraulic cylinder to the die is applied at one point. As the mold halves are brought together and their internal cavities are filled with melt, reacting forces are produced. The distribution of these forces is not uniform over the height of the mold, and their curve changes as the mold halves are brought together and the melt level rises in the mold cavities. The more remote the resultant of the reacting forces from the point at which the force produced by the hydraulic cylinder is applied, the greater the bending moment which destabilizes the dies. The distribution of the reacting forces is also nonuniform over the width of the mold; the resultant bending moment causes a misalignment. The above factors affect the dimensional accuracy of castings and account for rapid wear and frequent seizures of the dies.

There is known a squeezing caster according to USSR Inventor's Certificate No. 634,848, comprising a bed which carries a movable split-type intermediate carrier member and a bottom plate. The latter carries a rod intended to form the internal surface of a casting. The caster also incorporates two dies which are movable along the intermediate carrier member. The dies are driven by drives, each accommodated in a housing. The drive housing is mounted on the intermediate carrier member.

The dies are mounted on crosspieces which interact with the die drives.

Each of the cheeks is rigidly mounted on the intermediate carrier member and the housing. The caster is also provided with a drive for the intermediate carrier member. One of the drives brings the parts of the intermediate carrier member into abutting relation, after which the other drive brings the dies to their final position. As a result, the distance covered by the movable parts of the squeezing caster in contact with molten metal is reduced to a minimum of 10 to 12 mm, which considerably reduces wear of the bed and dies. However, that does not eliminate deformations and poor stability of the dies.

As the dies are brought closer together and the melt fills their cavities, reacting forces are produced. The distribution of these forces is not uniform over the height of the mold, and their curve changes as the dies are brought together and as the level of molten metal rises in their cavity. The more remote the resultant of the reacting forces from the point at which the force produced by the hydraulic cylinder is applied, the greater the bending moment which destabilizes the dies. The distribution of the reacting forces is also nonuniform over the width of the mold; the resultant bending moment causes a misalignment. The above factors affect the dimensional accuracy of castings and lead to rapid wear and frequent seizures of the dies.

SUMMARY OF THE INVENTION

It is an object of the present invention to reduce the bending of the dies through a uniform distribution of the force produced by the drive, and thus improve the dimensional accuracy of castings and reduce wear of the bed and cheeks.

It is another object of the invention to reduce the weight and size of the squeezing caster by minimizing the number of its drives.

It is still another object of the invention to improve the operational reliability of the squeezing caster by reducing the die sliding plane.

The foregoing objects are attained by providing a squeezing caster comprising a bed which carries a bottom plate, a split-type intermediate carrier member, and two dies, each provided with a means to drive the die along the intermediate carrier member and mounted on a crosspiece rigidly connected to said means which is accommodated in a housing mounted on the intermediate carrier member, which squeezing caster is characterized, according to the invention, in that it contains a means for a preliminary advance of one of the dies, and in that each of the die driving means comprises a rack and four pushers, each having a buttress thread on its external surface, meshed with an internal thread of a gear whose outer teeth are meshed with the rack, one of the racks being intended for connection to the rod of a drive cylinder and provided with a link kinematically coupled to the other rack.

The above squeezing caster design provides for a uniform distribution of the force transmitted from the drive and thus reduces the bending of the dies.

The force of the drive is transmitted through the four pushers and is thus applied at four points. At a point where the force of the drive is applied, the bending is zero, thus a maximum bending is observed only between the points at which the force of the drive is applied. The lesser the distance between these points, the lesser the bending.

It is preferable that the link be formed by two gears meshed with the rack and arranged symmetrically with respect to the longitudinal axis of the rack, each of the gears being rigidly mounted on an end of a shaft whose opposite end is coupled by means of a jaw clutch to an end of another shaft on whose opposite end there is rigidly mounted a gear meshed with the other rack.

The above link design and the way the link is kinematically coupled to the rack account for a reduced number of die drives, since both dies are driven in the longitudinal direction by a single drive cylinder.

It is advantageous that the means for a preliminary advance of one of the dies be a carriage carrying a die mounted on a crosspiece and a housing accommodating a mechanism to drive the die in the longitudinal direction, in which case one end of the carriage is connected to a rod of a power cylinder which drives the carriage whose other end has a locking means for centering the carriage in relation to the intermediate carrier member.

The use of a movable carriage makes it possible to reduce the size of the squeezing caster and the number of steps which make up a complete working cycle; it also improves the operational reliability of the caster by reducing the die sliding plane. The use of special locks cancels the force acting on the carriage at a moment the dies are brought in abutting relation; thus it is possible to arrange the power cylinder under the carriage and reduce the overall dimensions of the squeezing caster.

It is preferable that each of the four wheels of the carriage be mounted on an eccentric shaft installed in the carriage body so as to compensate for wear of the track on which the carriage rolls. Because of wear of the track and wheels, the carriage and the die it carries sink to a lower level, which affects the dimensional accuracy of castings and leads to rapid wear of the locking means. As the eccentric shaft is turned through a specified angle, the carriage is raised and the wear of the track and wheels is thus compensated for.

The squeezing caster according to-the invention is preferably provided with a means for adjusting the overhang of each pusher, designed as a chuck plate mounted on the end of each pusher opposite to the direction of pushing and having a central hole interacting with the end of the pusher and two slots for angular displacement of the chuck plate in relation to bolts which secure the chuck plate to a member of the mechanism for driving the die in the longitudinal direction, which member is stationary in relation to the housing. The use of such a means for adjusting the overhang of each pusher facilitates the assembly and dismantling of each die driving mechanism.

The movement of the dies is synchronized by adjusting the overhang of the pusher of the left die with respect to the right die, which overhang must be equal to the sum total of the clearances in the kinematic chain composed of the two gears, rack, shafts, two jaw clutches and other components.

BRIEF DESCRIPTION OF THE ACCOMPANYING DRAWINGS

Other objects and advantages of the present invention will become more apparent from a consideration of the following detailed description of a preferred embodiment thereof, taken in conjunction with the accompanying drawings, wherein.

DETAILED DESCRIPTION OF THE INVENTION

Figure 1:
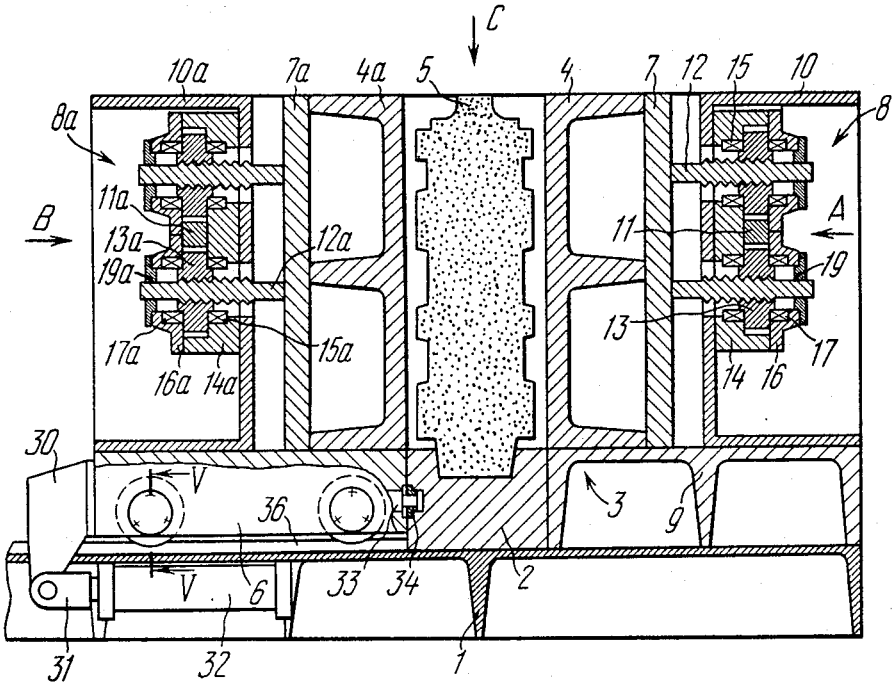
FIG. 1 is a schematic elevation view of a squeezing caster in accordance with the invention.

Referring to the attached drawings, the squeezing caster according to the invention comprises a bed 1 (FIG. 1) carrying a bottom plate 2, a split-type intermediate carrier member 3, and two dies, 4 and 4*a*, intended to form the outer shape of a casting. The bottom plate 2 carries a rod 5 intended to form the internal cavity of a casting.

One part of the intermediate carrier member 3 is movable, while the other is stationary and mounted on the bed 1. The movable part of the intermediate carrier member 3 is a carriage 6 which serves to advance preliminarily the die 4*a*. The die 4 is mounted on a crosspiece 7. The die 4*a* is mounted on a crosspiece 7*a*. The die 4 has a mechanism 8 which drives it along the stationary part 9 of the intermediate carrier member 3. The die 4*a* has a mechanism 8*a* which drives it along the carriage 6. The mechanism 8 is accommodated in a housing 10 mounted on the stationary part 9 of the intermediate carrier member 3. The mechanism 8*a* is accommodated in a housing 10*a* mounted on the movable carriage 6.

The mechanism 8 comprises a rack 11 (FIG. 2) and four pushers 12. Each of the pushers 12 has a buttress thread on its outer surface, which is meshed with an internal thread of a gear 13 (FIG. 1) whose outer teeth are meshed with the teeth of the rack 11. Rigidly installed in the housing 10 is a carrier plate 14 with rolling bearings 15 on which the four gears 13 are mounted. Each of the gears 13 is provided with a cover 16 (FIG. 2) in which rolling bearings 17 (FIG. 1) are installed. The squeezing caster according to the invention is provided with a means to adjust the overhang of each pusher 12 (FIG. 2), which is designed as a chuck plate 18 mounted on the end of each pusher 12 opposite to the direction of pushing. The chuck plate 18 has a central hole 19 and two slots 20. The slots 20 provide for angular displacement of the chuck plate 18 in relation to bolts (not shown) which secure the plate 18 to the cover 16. The central hole 19 of the chuck plate 18 interacts with the end of the pusher 12.

The mechanism 8*a* (FIG. 1) for driving the die 4*a* in the longitudinal direction comprises a rack 11*a* and four pushers 12*a*. Each of these has a buttress thread on its outer surface, which is meshed with an internal thread of a gear 13*a* whose outer teeth are meshed with the teeth of the rack 11*a*. Rigidly arranged in the housing 10*a* is a carrier plate 14*a* with rolling bearings 15*a* on which the four gears 13*a* are mounted. Each of the gears 13*a* is provided with a cover 16*a* in which rolling bearings 17*a* are installed.

Figure 3:
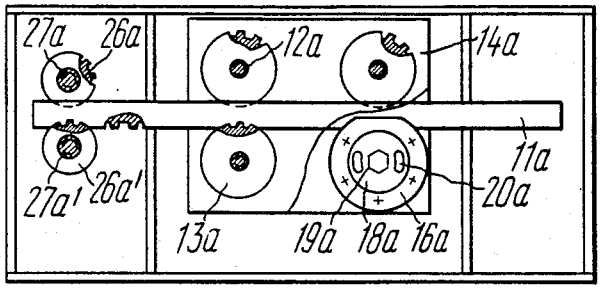
FIG. 3 is a view of the pushers in the direction of arrow B in FIG. 1.

The squeezing caster according to the invention is provided with a means to adjust the overhang of each pusher 12*a* (FIG. 3), which is designed as a chuck plate 18*a* mounted on the end of each pusher 12*a* opposite to the direction of pushing. The chuck plate 18*a* has a central hole 19*a* and two slots 20*a*. The slots 20*a* provide for angular displacement of the chuck plate 18*a* in relation to bolts (not shown) which secure the plate 18*a* to the cover 16*a*. The central hole 19*a* of the chuck plate 18*a* interacts with the end of the pusher 18*a*.

Figure 2:
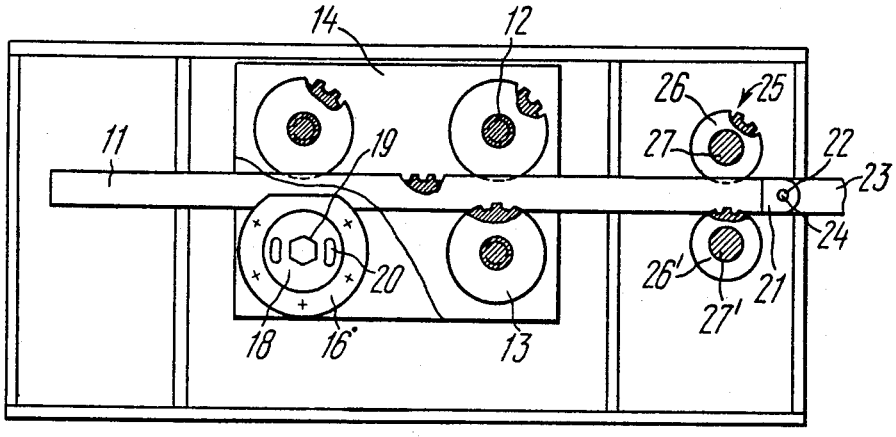
FIG. 2 is a view in the direction of arrow A in FIG. 1.

At one end of the rack 11 (FIG. 2) there is an eye 21 with a hole 22 to connect the rack 11 to a rod 23 of a power cylinder (not shown) by means of an axle 24 (FIG. 2). The rack 11 also has a link 25 kinematically coupled to the other rack 11*a* (FIG. 1). The link 25 (FIG. 2) comprises two gears, 26 and 26', symmetrically arranged with respect to the longitudinal axis of the rack 11 and meshed with the latter. The gears 26 and 26' are rigidly mounted on ends of shafts 27 and 27', respectively. The opposite end of the shaft 27 (FIG. 4) is coupled by means of a jaw clutch 28 to a shaft 27*a*. Rigidly mounted on the opposite end of the shaft 27*a* (FIG. 3) is a gear 26*a* meshed with the rack 11*a*. The opposite end of the shaft 27 (FIG. 4) is coupled by means of a jaw clutch 29 to the shaft 27*a*. Rigidly mounted on the opposite end of the shaft 27'*a* (FIG. 3) is a gear 26'*a* meshed with the rack 11*a*. The gears 26*a* and 26'*a* are arranged symmetrically with respect to the longitudinal axis of the rack 11*a*.

The movable carriage 6 (FIG. 1) carries the die 4*a* mounted on the crosspiece 7*a*, and the housing 10*a* which accommodates the mechanism 8*a* for driving the die 4*a* in the longitudinal direction.

Mounted at one end of the carriage 6 is a bracket 30 hingedly connected to a rod 31 of a power cylinder 32. The latter is rigidly mounted on the bed 1. Arranged at the opposite end of the carriage 6 is a locking means which is a pin 33. The bottom plate 2 accommodates a bushing 34. As the dies are brought closer together, the pin 33 is received in the bushing 34, whereby the dies 4 and 4*a* are locked together.

Figure 5:
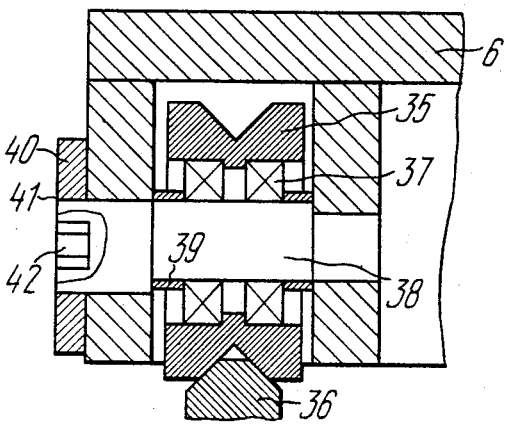
FIG. 5 is a sectional view taken along the line V—V in FIG. 1.

The four wheels 35 (FIG. 5) of the carriage 6 roll on a track 36. Each of the wheels 35 is mounted on a bearing 37 mounted on an eccentric shaft 38 and locked in place by a bushing 39 which prevents displacement of the wheel along the shaft. Mounted at one end of each shaft 38 is a washer 40 whose central hole 41 interacts with the end of the shaft. The purpose of the washer 40 is to prevent rotation of the eccentric shaft 38. Each of the shafts 38 has hexagonal hole 42 and serves to adjust the height of the carriage 6. Each washer 40 is bolted to the body of the carriage 6 (the bolts are not shown).

Figure 4:
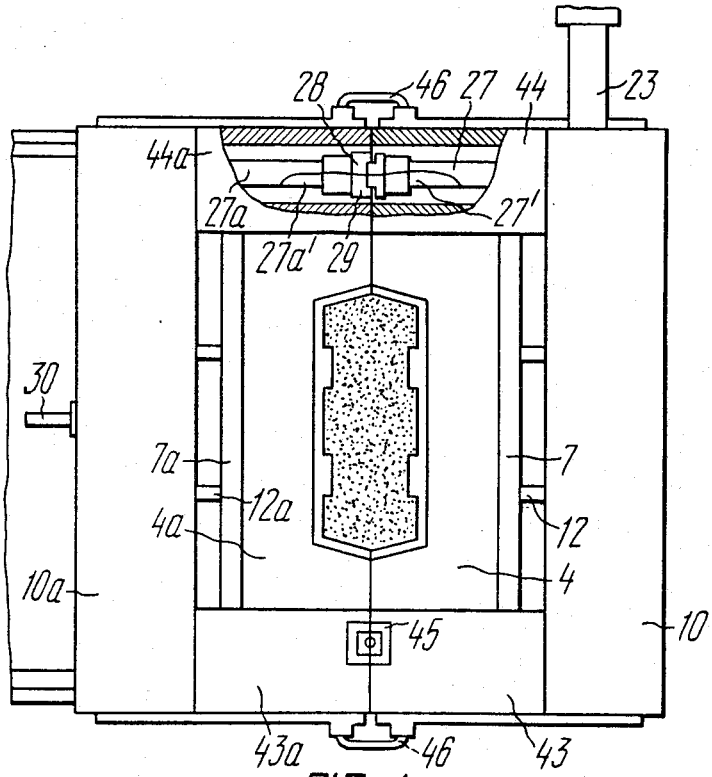
FIG. 4 is a view in the direction of arrow C.

The squeezing caster according to the invention contains, cheeks 43, 43*a* and 44, 44*a* (FIG. 4) of the split type. The parting line of the cheeks 43, 43*a* and 44, 44*a* is matched with that of the dies 4 and 4*a*. The cheeks 43 and 44 are mounted on the stationary part of the intermediate carrier member 3 (FIG. 1) and on the housing 10 (FIG. 4). The cheeks 43*a* and 44*a* are rigidly mounted on the housing 10*a* and carriage 6 (FIG. 1).

A gating system 45 is arranged along the parting line of the cheeks 43 (FIG. 1) and 43*a*.

Locks 46 prevent opening of the die 4*a*, cheeks 43*a*, 44*a* and housing 10*a* mounted on the carriage 6 (FIG. 1) in relation to the die 4 (FIG. 4), cheeks 43, 44 and housing 10.

The squeezing caster according to the invention operates as follows.

The power cylinder 32 (FIG. 1) drives the dies 4 and 4*a* preliminarily towards each other. Through the bracket 30, the rod 31 of the power cylinder 32 drives the carriage 6 along the track 36 until the pin 33 is received in the bushing 34. The locks 46 (FIG. 4) are then closed. At this point the preliminary advance of the dies towards each other is over. A molten nonferrous metal is poured through the gating system 45 into the cavity formed by the walls of the dies 4 and 4*a*, the cheeks 43, 43*a*, 44, 44*a*, the bottom plate 2 (FIG. 1) and the lateral surface of the rod 5. The dies 4 and 4*a* are brought into abutting relation. The rod 23 (FIG. 2) of the power cylinder (not shown) transmits motion to the rack 11 whose teeth interact with those of the gears 13. The internal thread of the gears 13 (FIG. 1) interacts with the external buttress thread of the pushers 12, whereby these are driven in the longitudinal direction. The pushers 12 act on the crosspiece 7 and move the die 4 in the longitudinal direction towards the rod 5.

At the same time the teeth of the rack 11 (FIG. 2) interact with the teeth of the gears 26 and 26'. Through the shaft 27 (FIG. 4) and jaw clutch 28, the gear 26 transmits motion to the shaft 27*a*. Through the shaft 27' and jaw clutch 29, the gear 26' transmits motion to the shaft 27'*a*. The gears 26*a* (FIG. 3) and 26'*a* are mounted on the ends of the shafts 27*a* and 27'*a*, respectively, and interact with the rack 11*a*, driving it in the longitudinal direction. As the rack 11*a* is set in motion, its teeth interact with those of the gears 13*a*. The internal thread of the gears 13*a* (FIG. 1) interacts with the external thread of the pushers 12*a*, whereby these are driven in the longitudinal direction. The ends of the pushers 12*a* act on the cross-piece 7*a* and drive the die 4*a* in the longitudinal direction towards the rod 5. As the dies 4 and 4*a* are brought together, the melt is squeezed upwards and a casting is thus produced.

The foregoing design reduces the bending of the dies and wear of the bed and cheeks. It also improves the dimensional accuracy of castings. This is due to a uniform distribution of the squeezing force over the plane of the dies, which, in turn, is due to the fact that the force is applied at several points. The bending is zero at a point where the force is applied. Clearly, a maximum bending occurs between the points at which the force is applied. However, the bending is limited due to a small distance between these points. The use of a carriage improves the operational reliability of the squeezing caster by reducing the die sliding plane. The carriage also accounts for a reduced size of the caster and a reduced number of steps which make up a working cycle of the machine.

The compact die driving mechanism and the reduced number of the drives are also factors which make the machine more compact than its predecessors.

What is claimed is:

1. A squeezing caster comprising:

a bed;

a bottom plate attached to said bed;

an intermediate carrier member having first and second parts mounted on said bed;

two dies for forming the outer shape of a casting;

a first housing mounted on the first part of said carrier member;

a second housing mounted on the second part of said carrier member;

a first driving means for driving a first of said two dies in a longitudinal direction, accommodated in said first housing;

a second means for driving the second of said two dies in the longitudinal direction, accommodated in said second housing;

a first crosspiece mounted on the first of said two dies;

a second crosspiece mounted on the second of said two dies;

a first rack of said first driving means being connected to a rod of a drive cylinder;

a second rack of said second driving means being operatively connected to the first rack;

four pushers of said first driving means rigidly attached to said first crosspiece, each of said four pushers of said first driving means having a buttress thread on its outer surface;

four pushers of said second driving means rigidly attached to said second crosspiece, each of said four pushers of said second driving means having a buttress thread on its outer surface;

four gears of said first driving means having an internal thread meshed with the buttress thread of said four pushers of said first driving means, and outer teeth meshed with said first rack;

four gears of said second driving means having an internal thread meshed with the buttress thread of said four pushers of the second driving means, and outer teeth meshed with second rack, said second rack being operatively connected to said first rack by a link mounted on said first rack and kinematically coupled to said second rack to transmit movement from the first driving means to said second driving means, said second part preliminarily advancing the second of said two dies.

2. A squeezing caster as claimed in claim 1, comprising:

two gears of said link, arranged symmetrically in relation to the longitudinal axis of the first rack and meshed with said first rack;

a first shaft with the first of said two gears of said link mounted on its end;

a second shaft with the second of said two gears of said link mounted on its end;

two jaw clutches;

a third shaft;

a fourth shaft;

a third gear mounted on one end of said third shaft whose free end is coupled by means of one of said two jaw clutches to said first shaft, and interacting with said second rack;

a fourth gear mounted on one of said fourth shaft whose free end is coupled by means of the second jaw clutch to said second shaft, interacting with said second rack of said second driving means and arranged symmetrically in relation to the longitudinal axis of said second rack of said third gear.

3. A squeezing caster as claimed in claim 1, wherein said second part of the carrier member comprises a movable carriage which carries said second die mounted on said second crosspiece a rod of a power cylinder, connected to one end of said movable carriage for movement in the longitudinal direction;

a locking means arranged at an end opposite said end of said carriage for centering said movable carriage in relation to said first part of carrier member.

4. A squeezing caster as claimed in claim 3, comprising:

four eccentric shafts, each installed in the body of said movable carriage;

four wheels of said movable carriage, each mounted on one of said four eccentric shafts.

5. A squeezing caster as claimed in claim 4, comprising:

a means to adjust the overhang of each of said four pushers of said second driving means;

a chuck plate of said means, mounted at the end of each pusher opposite to the direction of pushing and having a central hole interacting with the end of the pusher and two slots for longitudinal displacement of said chuck plate;

bolts to secure said chuck plate to a member of said second driving means, which member is stationary in relation to said second housing.

6. A squeezing caster as claimed in claim 1, comprising:

a means to adjust the overhang of each of said four pushers of said first driving means;

a chuck plate of said means, mounted at the end of each pusher opposite to the direction of pushing and having a central hole interacting with the end of the pusher and two slots for angular displacement of said chuck plate;

bolts to secure said chuck plate to a member of said first driving means, which member is stationary in relation to said first housing.

* * * * *